US008215608B2

(12) United States Patent
Oleson

(10) Patent No.: US 8,215,608 B2
(45) Date of Patent: Jul. 10, 2012

(54) CURVED CONCRETE RADIUS FORMING SYSTEM HAVING FLEXIBLE FORM MEMBERS WITH ATTACHED STAKE HOLDERS

(75) Inventor: Larry O. Oleson, South Milwaukee, WI (US)

(73) Assignee: Metal Forms Corporation, Milwaukee, WI (US)

( * ) Notice: Subject to any disclaimer, the term of this patent is extended or adjusted under 35 U.S.C. 154(b) by 1132 days.

(21) Appl. No.: 11/633,192

(22) Filed: Dec. 4, 2006

(65) Prior Publication Data

US 2008/0128581 A1 Jun. 5, 2008

(51) Int. Cl.
*E04G 9/05* (2006.01)
*E04G 11/00* (2006.01)

(52) U.S. Cl. ..... 249/6

(58) Field of Classification Search ..... 249/2, 3, 249/4, 5, 6, 7, 9, 208
See application file for complete search history.

(56) References Cited

U.S. PATENT DOCUMENTS 965,979 A 8/1910 Young
985,035 A * 2/1911 Hotchkiss ..... 249/9
2,846,748 A 8/1958 Owen et al.
4,579,312 A 4/1986 White
4,712,764 A 12/1987 White
4,750,703 A 6/1988 Gentilcore et al.
4,776,555 A 10/1988 Maynard
5,154,837 A 10/1992 Jones
5,863,453 A * 1/1999 Hardin ..... 249/196
6,021,994 A 2/2000 Shartzer, Jr.
6,536,737 B1 * 3/2003 Davis ..... 249/3
6,629,681 B1 10/2003 Miller et al.
6,866,239 B2 3/2005 Miller et al.
2003/0146365 A1 * 8/2003 Miller et al. ..... 249/3

* cited by examiner

*Primary Examiner* — Michael Safavi

(74) *Attorney, Agent, or Firm* — Greer, Burns & Crain, Ltd.

(57) ABSTRACT

A radius forming system has at least one flexible form member with a plurality of stake pockets. The stake pockets are each formed in a single piece having a first and second opening therethrough arranged to receive a fastening element and an intermediate portion having an enclosing shape defining a stake holder. The intermediate portion has at least one opening therethrough and a locking member is received in the opening arranged to engage a stake positioned in the stake holder. The form member has a plurality of vertically aligned pairs of openings spaced along the length of the form member. A plurality of fastening elements are received in the various openings in the form member and the stake pockets to hold the form member and stake pockets together.

20 Claims, 4 Drawing Sheets

CURVED CONCRETE RADIUS FORMING SYSTEM HAVING FLEXIBLE FORM MEMBERS WITH ATTACHED STAKE HOLDERS

BACKGROUND OF THE INVENTION

The present invention generally relates to a radius forming system for forming flatwork concrete and cement structures, such as sidewalks, roads, and similar constructions.

Concrete forming systems have been in use for a long time, and include various types of structures, including those made of wood and those made of metal. While wood and metal forms are generally used for forming straight sections, oftentimes it is necessary to form curved sections, with various sized radii. Metal forms are available for forming some curved sections, such as disclosed in U.S. Pat. Nos. 965,979, 2,846,748, and 5,154,837 as are wooden forms, however, generally only very large radii can be formed with such forms.

In order to form curves having a smaller radius, special forms must be constructed, usually of materials that can be used only a single time, such as Masonite®, plywood and "bender board" and often require significant labor to be employed in constructing the form, putting it in place and subsequently removing it.

Plastic forms have been provided for concrete forming systems, to take the place of metal or wood forms. Such forms have various structural features to enhance the rigidity of the forms, to compensate for their reduced rigidity, as compared to metal or wood forms, yet allow the reduced weight and reusability for the forms. Various plastic or flexible forms are disclosed in U.S. Pat. Nos. 4,579,312, 4,712,764, 4,750,703, 4,776,555, 6,021,994, 6,629,681 and 6,866,239.

Plastic forms are well suited for forming curves, however, because of the structural features incorporated into the plastic forms to enhance their rigidity, such forms are useful for forming curves generally where the radius is no less than about 3 feet. Difficulty still arises in trying to construct concrete shapes with radii of less than about 3 feet.

SUMMARY OF THE INVENTION

The present invention provides a radius forming system for forming concrete with curves having a radius of less than 3 feet, and down to about 6 inches. The radius forming system includes at least one flexible form member and a plurality of stake pockets. The stake pockets are each formed in a single piece having a first end with a first opening therethrough arranged to receive a fastening element and a second end with a second opening therethrough spaced a first distance from the first opening and arranged to receive a fastening element and an intermediate portion having an enclosing shape defining a stake holder. The intermediate portion has at least one opening therethrough and a locking member is received in the opening arranged to engage a stake positioned in the stake holder.

The form member is formed of a single thickness and has a plurality of first openings and second openings vertically aligned and spaced along the length of the form member, spaced from each other by the first distance and each opening is arranged to receive a fastening element. A plurality of fastening elements are received in the various openings in the form member and the stake pockets to hold the form member and stake pockets together.

In an embodiment, the radius forming system has a plurality of form members, and a form connector is provided for connecting adjacent form members. In such an embodiment, the form members have a third opening and a fourth opening vertically aligned and spaced a second distance from each other and a third distance from the first end of the form member and each opening is arranged to receive a fastening element. The form connector is formed of a single flat plate a having third opening and a fourth opening vertically spaced from each other by the second distance and spaced from an edge of the plate by a fourth distance greater than the third distance and arranged to receive fastening elements. The fastening elements are also used to hold the form member and end connector together. Adjacent forms are abutted end to end, and the form connector attached to the first end of one form will overlie a portion of the second end of the next form to prevent the end of the second form from moving relative to the first form.

In an embodiment, the stake pocket is formed of metal.

In an embodiment, the end connector is formed of metal.

In an embodiment, the intermediate portion has at least a partial circular shape defining the stake holder.

In an embodiment, the intermediate portion has a full circular shape.

In an embodiment, the opening through the intermediate portion is threaded.

In an embodiment, the threaded opening comprises a threaded nut secured to the stake pocket.

In an embodiment, the locking member comprises a threaded locking pin with an end arranged to engage a stake positioned in the stake holder.

In an embodiment, the locking pin has a knob shaped handle, and in another embodiment, the locking pin is formed in an L shape.

In an embodiment, the fastening elements comprise threaded bolts.

In an embodiment, the flexible form member is made of a plastic material.

In an embodiment, the plastic material is polyethylene.

In an embodiment, the thickness of the flexible form member is between 0.125 and 0.50 inches.

In an embodiment, the height of the flexible form member is between 3 and 12 inches.

In an embodiment, the length of the flexible form member is between 6 and 15 feet.

In an embodiment, between 1 and 12 stake pockets are provided for each flexible form member.

DETAILED DESCRIPTION OF THE PREFERRED EMBODIMENT

Figure 1:
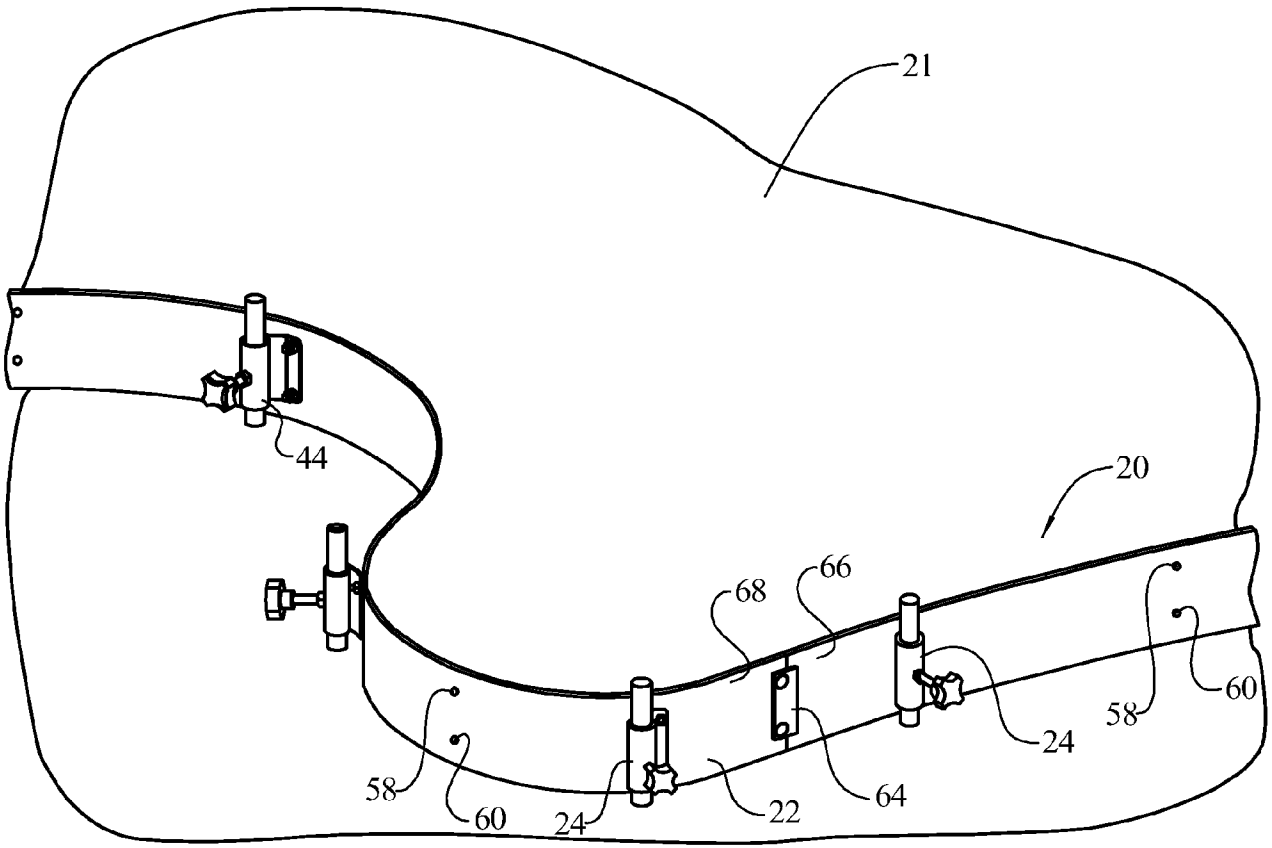
FIG. 1 is a perspective view of a radius forming system embodying the principles of the present invention in use.
Figure 2:
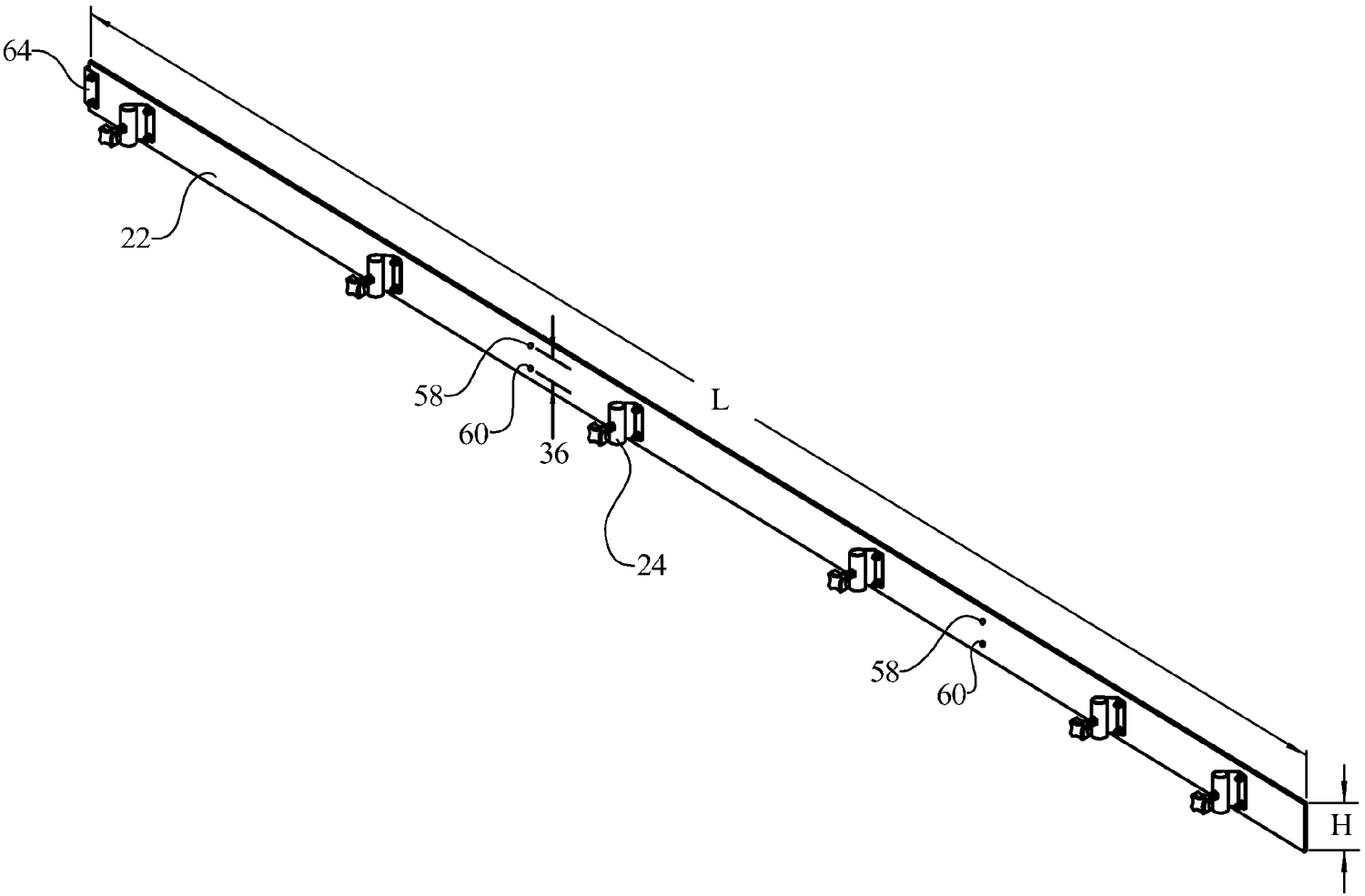
FIG. 2 is a perspective view of the radius forming system of FIG. 1 in isolation.
Figure 4:
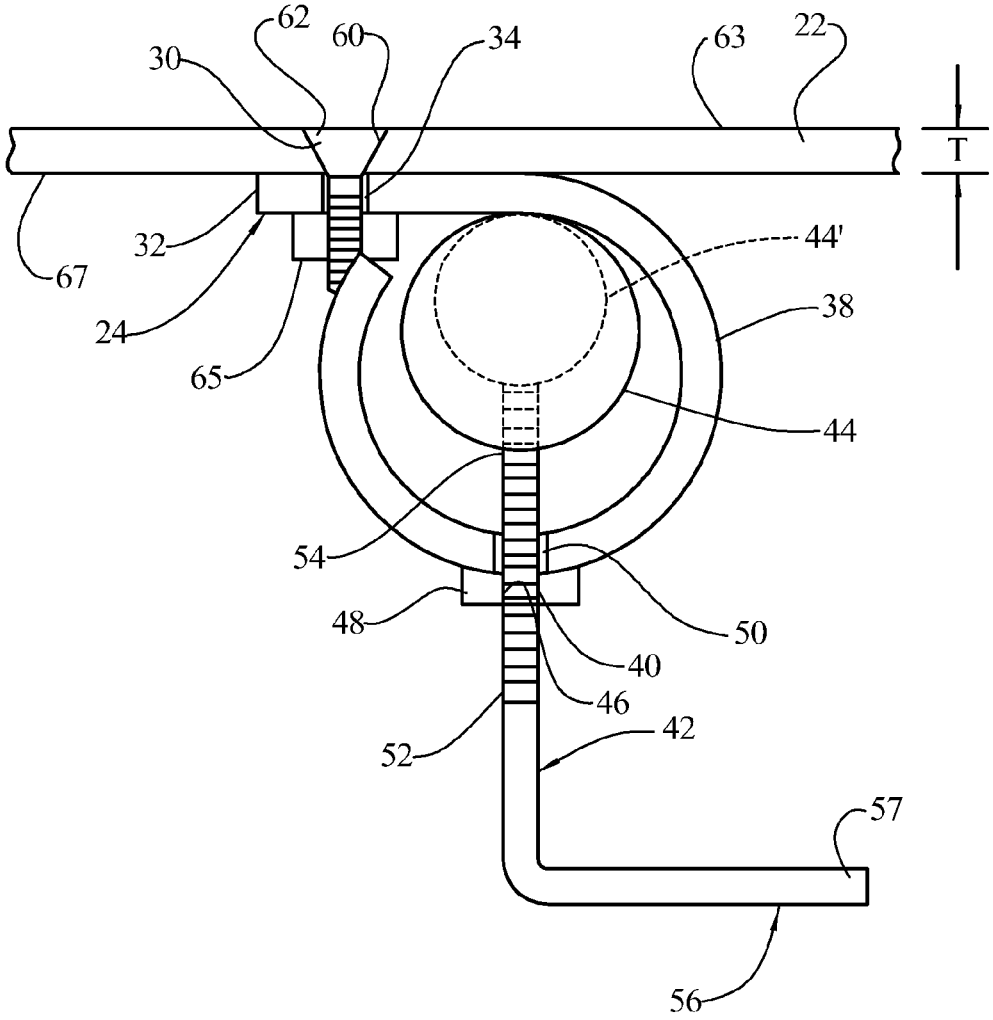
FIG. 4 is a sectional view of an alternative embodiment of the stake pocket.

While the present invention may be embodied in many different forms, there is shown in the drawings and discussed herein one or more specific embodiments of a radius forming system 20 for forming concrete. The system 20 as shown in place in FIG. 1 with a concrete pour 21, includes a flexible form member 22 and a plurality of stake pockets 24. The flexible form member 22 may be made of a plastic material, such as high density polyethylene, which is sufficiently stiff to support its own shape, and is resistant to chemical attack by chemicals found in wet cement and concrete. As seen in FIG. 2, the flexible form member 22 is formed of a single wall thickness of material and has a height H, a length L and a thickness T (FIG. 4). The height H may be in the range of 2 to 12 inches, as needed for a particular concrete forming situation. The length L is preferably in the range of 6 to 15 feet, in order to make the forms easy to transport, yet also to be practical for a wide range of forming projects. The forms 22 may be joined end to end, as discussed below, to increase their length. The thickness T of the form member 22 is preferably in the range of 0.125 to 0.50 inches, which will allow the form to be flexible for forming relatively small radiuses, of less than 3 feet and down to about 6 inches, yet strong and sturdy enough to support the concrete and cement being formed.

Figure 3:
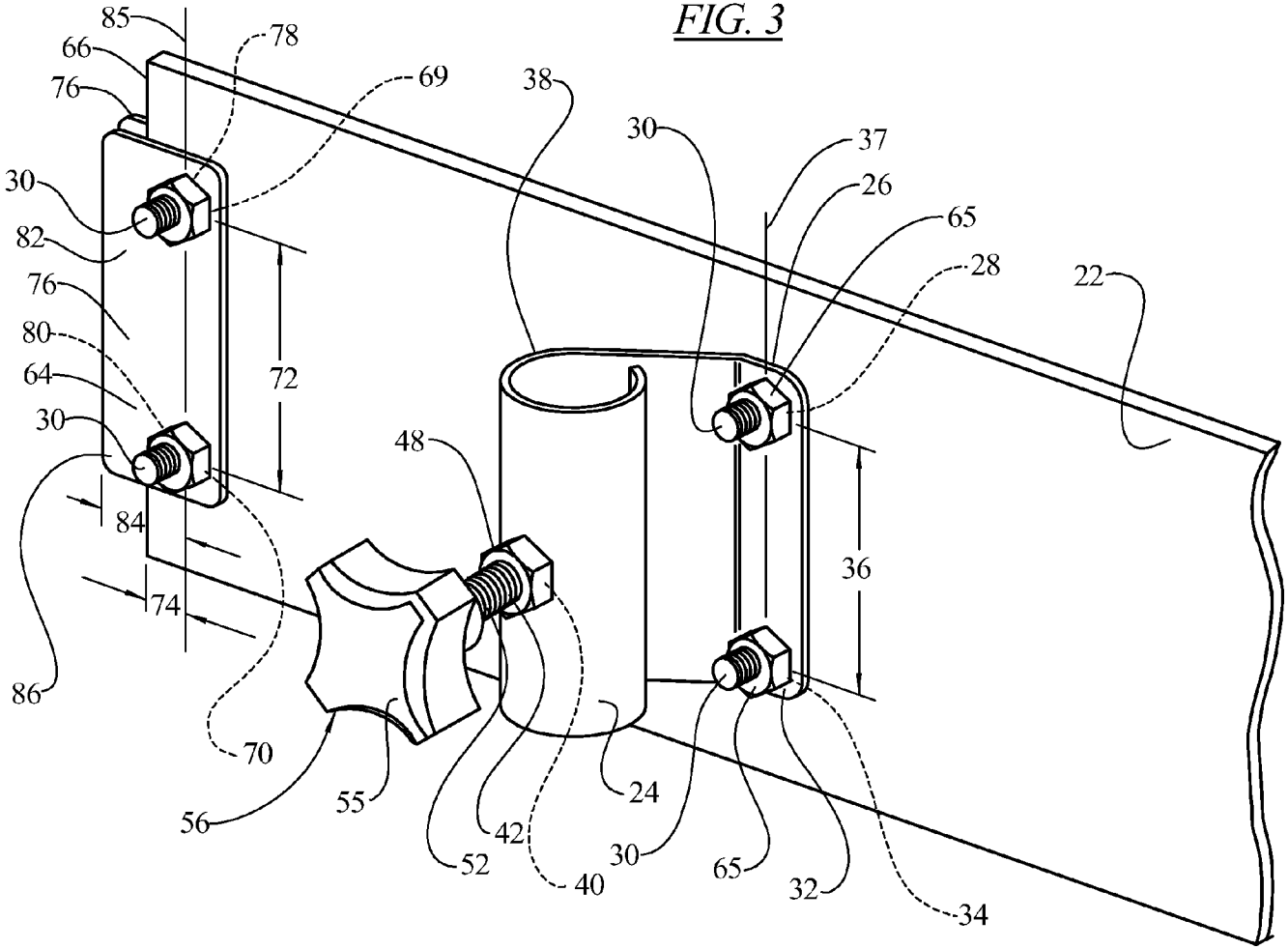
FIG. 3 is a side cross sectional view of a portion of the radius forming system of FIG. 1.

The stake pockets 24 (different embodiments being shown in FIGS. 3 and 4) are each formed in a single piece, preferably of a rigid material, such as metal, like special analysis steel, or a suitable rigid plastic material. The stake pockets 24 include a plurality of fastener openings therethrough for attaching the stake pockets to the form members 22, the plurality of fastener openings being all of the openings in the stake pockets for attaching the stake pockets to the form members and have a first end 26 with a first opening 28 therethrough arranged to receive a fastening element 30 and a second end 32 with a second opening 34 therethrough spaced a first distance 36 from the first opening and arranged to receive a fastening element 30. The positions and orientations of the fastening element openings may be changed and the number of openings used with each stake pocket can be changed as well. In the embodiment shown in FIG. 3, all of the plurality of fastener openings 28, 34 in the stake pocket 24 are arranged along a single generally vertical line 37. The stake pockets 24 also have an intermediate portion 38 with an enclosing shape defining a stake holder. In an embodiment, the enclosing shape of the intermediate portion 38 is circular, which may include a partial or a full circle. In other embodiments, the enclosing shape of the intermediate portion 38 could be angular, such as triangular, square or rectangular.

The intermediate portion 38 has at least one opening 40 therethrough, and a locking member 42 is received in the opening arranged to engage a stake 44 positioned in the stake holder 38. In an embodiment, the opening 40 is threaded, as at 46, and in some configurations, the threaded opening may be formed by a threaded nut 48 secured to the intermediate portion 38, such as by welding. The threaded nut 48, if used, would overlie an opening 50 in the intermediate portion 38 which may or may not be threaded. In an embodiment where the opening 40 is threaded, the locking member 42 may comprise a threaded locking pin 52 with an end 54 arranged to engage the stake 44 positioned in the stake holder 24. The locking pin 52 may be provided with a knob 55 (FIG. 3) forming a handle portion 56 for applying torque to the locking pin. Other shapes and arrangements for the locking pin 52 may be used, such as an L-shaped pin, as shown in FIG. 4, in which the bent portion 57 forming the L forms the handle portion 56. No nailing is required to set the forms 22 or nail removal is needed to strip the forms. With the used of the threaded locking pin 52, fast vertical adjustment of the form 22 to a stringline used in the flatwork process is permitted.

In other embodiments, the opening 40 in the intermediate portion 38 may be two spaced apart openings, and the locking member 42 could be a wedge shaped member, such as disclosed in U.S. Pat. No. 6,629,681, incorporated herein by reference.

The size and configuration of the enclosing shape of the intermediate portion 38 should be selected to accommodate various sized stakes 44, 44' commonly used, such as 0.75 inch and 0.875 inch diameter stakes.

The form member 22 has a plurality of first openings 58 and second openings 60 which may be vertically aligned and spaced along the length of the form member. The first and second openings 58, 60 are spaced from each other by the first distance 36 and each is arranged to receive a fastening element 30. The openings 58, 60 should be arranged to align with the openings 28, 34 in the stake pockets 24 and to match whatever number and arrangement is used for the stake pocket openings. An advantage of using two openings vertically aligned is that the flexibility of the form member 22 along its length is not restricted as it would be if the openings were spaced longitudinally along the form member for each stake pocket 24. A number of openings 58, 60 can be preformed in the form member 22 to allow the selection and placement of the appropriate number of stake pockets 24 required for a particular installation. For example, between 1 and 12 pairs of openings 58, 60 can be preformed in the form member 22, or additional pairs, depending on the length of the form member. Of course, additional openings 58, 60 can be provided in the field when necessary for a particular installation. Where the desired radius to be formed by the form member 22 is smaller, the number of stake pockets 24 used for each given length of the form member may need to be increased, so that the form member is supported to maintain the proper curvature of the desired radius.

A plurality of the fastening elements 30 are received in the various openings in the form member 22 and the stake pockets 24 to hold the form member and stake pockets together. In an embodiment, the fastening elements 30 may comprise bolts with heads 62 that are rounded or are recessed in the form member 22, so as to leave a minimal to non-existent indentation in the formed concrete which is to be poured on the fastener head side 63 of the form member 22 and nuts 65 engaging a threaded portion of the fastening element on an opposite side 67 of the form member.

In an embodiment, the radius forming system 20 has a plurality of form members 22, and a form connector 64 is provided for connecting adjacent form members. In such an embodiment, the flexible form members 22 may be arranged in series with a first end 66 of one flexible form member abutting a second end 68 of the next flexible form member.

To accommodate the form connector 64, the form members 22 have a third opening 69 and a fourth opening 70 which may be vertically aligned and spaced a second distance 72 from each other and a third distance 74 from the first end 66 of the form member and each arranged to receive a fastening element 30. The form connector 64 may be formed of a single flat plate 76, preferably made of a rigid material, such as metal or a suitable rigid plastic, having a plurality of fastener openings therethrough for attaching the form connector to one of the form members, the plurality of fastener openings being all of the openings in the form connector for attaching the form connector to the form member and including a third opening 78 and a fourth opening 80 vertically spaced from each other by the second distance 72 and spaced from an edge 82 of the plate by a fourth distance 84 greater than the third distance 74 and arranged to receive fastening elements 30. In the embodiment shown in FIG. 3, all of the plurality of fastener openings 78, 80 in the form connector 64 are arranged along a single generally vertical line 85. The form connector 64 may alternatively be formed of two flat plates 76 that sandwich the form member 22 therebetween at the first end 66. Fastening elements 30 are also used to hold the form member 22 and form connector 64 together.

The form connector 64 has a portion 86 which extends longitudinally beyond the first end 66 of the form member 22, which will overlie the second end 68 of the adjacent form member. Although no separate fasteners are required between the second end 68 of the adjacent form member 22 and the extending portion 86, the extending portion will provide a rigid backing and support for the second end, especially once the concrete is poured and is pressing against the form members. When the form connector 64 is formed of two flat plates, the second end 68 of the adjacent form member 22 is captured between the two plates, and is held in place. The plates 76 are thin enough that even when a second plate is used on the concrete side of the form, the impression it leaves in the formed concrete is nearly invisible. Toe-nailing and other creative splicing procedures that are labor-intensive and damage the forms at the end joints are eliminated with the use of the form connector 64.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The invention claimed is:

1. A radius forming system comprising:

a plurality of flexible form members, each formed of a single wall thickness having a height, length and thickness, with a first end and a second end, a plurality of stake pockets, and a form connector, the stake pockets each being formed in a single piece having a plurality of fastener openings therethrough for attaching the stake pockets to the form members, the plurality of fastener openings being all of the openings in the stake pockets for attaching the stake pockets to the form members and including a first fastener opening therethrough arranged in a first end of the stake pocket to receive a fastening element and a second fastener opening therethrough spaced a first distance from the first fastener opening and arranged in a second end of the stake pocket to receive a fastening element and an intermediate portion having an enclosing shape defining a stake holder, the intermediate portion having at least one opening therethrough, and a locking member being received in the opening arranged to engage a stake positioned in the stake holder, all of the plurality of fastener openings in each stake pocket being arranged along a single generally vertical line, the form members each having a plurality of first openings and second openings spaced from each other by the first distance and spaced along the length of each form member, and each opening arranged to receive a fastening element, a third opening and a fourth opening spaced a second distance from each other and a third distance from the first end of each form member and each opening arranged to receive a fastening element, the form connector being formed of a single flat plate having a plurality of fastener openings therethrough for attaching the form connector to one of the form members, the plurality of fastener openings being all of the openings in the form connector for attaching the form connector to the form member and including a third fastener opening and a fourth fastener opening spaced from each other by the second distance and spaced from an edge of the plate by a fourth distance greater than the third distance and arranged to receive fastening elements, all of the plurality of fastener openings in the form connector being arranged along a single generally vertical line, and a plurality of fastening elements received in the various openings in each form member, the stake pockets and the end connector to hold the form members and stake pockets and the form members and end connector together.

2. A radius forming system according to claim 1, wherein the stake pocket is formed of metal.

3. A radius forming system according to claim 1, wherein the end connector is formed of metal.

4. A radius forming system according to claim 1, wherein the intermediate portion has at least a partial circular shape defining the stake holder.

5. A radius forming system according to claim 4, wherein the intermediate portion has a full circular shape.

6. A radius forming system according to claim 1, wherein the opening through the intermediate portion is threaded.

7. A radius forming system according to claim 6, wherein the threaded opening comprises a threaded nut secured to the stake pocket.

8. A radius forming system according to claim 6, wherein the locking member comprises a threaded locking pin with an end arranged to engage a stake positioned in the stake holder.

9. A radius forming system according to claim 1, wherein the locking pin is formed with a knob shaped handle.

10. A radius forming system according to claim 1, wherein the fastening elements comprise threaded bolts.

11. A radius forming system according to claim 1, wherein the flexible form members are made of a plastic material.

12. A radius forming system according to claim 7, wherein the plastic material is polyethylene.

13. A radius forming system according to claim 1, wherein the thickness of the flexible form members is between 0.125 and 0.50 inches.

14. A radius forming system according to claim 1, wherein the height of the flexible form members is between 3 and 12 inches.

15. A radius forming system according to claim 1, wherein the length of the flexible form members is between 6 and 15 feet.

16. A radius forming system according to claim 1, wherein between 1 and 12 stake pockets are provided for each flexible form member.

17. A radius forming system according to claim 1, wherein the flexible form members are arranged in series with the first end of one flexible form member abutting the second end of the next flexible form member.

18. A radius forming system comprising:

at least one flexible form member having a single wall thickness with a height, length and thickness, with a first end and a second end, and a plurality of stake pockets, the stake pockets each being formed in a single piece having a plurality of fastener openings therethrough for attaching the stake pockets to the form member, the plurality of fastener openings being all of the openings in the stake pockets for attaching the stake pockets to the form member and including a first fastener opening therethrough arranged in a first end of the stake pocket to receive a fastening element and a second fastener opening therethrough spaced a first distance from the first fastener opening and arranged in a second end of the stake pocket to receive a fastening element and an intermediate portion having an enclosing shape defining a stake holder, the intermediate portion having at least one threaded opening therethrough, and a locking member in the form of a threaded locking pin being received in the opening with an end of the pin arranged to engage a stake positioned in the stake holder, all of the plurality of fastener openings in each stake pocket being arranged along a single generally vertical line, the form member having a plurality of first openings and second openings vertically aligned and spaced along the length of the form member, spaced from each other by the first distance and each arranged to receive a fastening element, and a plurality of fastening elements received in the various openings in the form member and the stake pockets to hold the form member and stake pockets together.

19. A radius forming system according to claim 18, wherein the enclosing shape of the intermediate portion is circular.

20. A radius forming system comprising:

a plurality of flexible plastic form members, each having a single wall thickness with a height, length and thickness, with a first end and a second end, a plurality of stake pockets, and a form connector, the stake pockets each being formed of a single piece of metal having a plurality of fastener openings therethrough for attaching the stake pockets to the form members, the plurality of fastener openings being all of the openings in the stake pockets for attaching the stake pockets to the form members and including a first fastener opening therethrough arranged in a first end of the stake pocket to receive a fastening element and a a second fastener opening therethrough spaced a first distance from the first fastener opening and arranged in a second end of the stake pocket to receive a fastening element and an intermediate portion having a circular shape defining a stake holder, the intermediate portion having at least one threaded opening therethrough, and a threaded locking pin being received in the opening with an end arranged to engage a stake positioned in the stake holder, all of the plurality of fastener openings in each stake pocket being arranged along a single generally vertical line, the form members each having a plurality of first openings and second openings vertically aligned and spaced from each other by the first distance and spaced along the length of each form member, and each first and second opening arranged to receive a fastening element, a third opening and a fourth opening vertically aligned and spaced a second distance from each other and a third distance from the first end of each form member and each third and fourth opening arranged to receive a fastening element, the form connector being formed of a single flat metal plate having a plurality of fastener openings therethrough for attaching the form connector to one of the form members, the plurality of fastener openings being all of the openings in the form connector for attaching the form connector to the form member and including a third fastener opening and a fourth fastener opening vertically spaced from each other by the second distance and spaced from an edge of the plate by a fourth distance greater than the third distance and arranged to receive fastening elements, all of the plurality of fastener openings in the form connector being arranged along a single generally vertical line, and a plurality of threaded fastening elements received in the various openings in the form members, the stake pockets and the end connector to hold the form members and stake pockets and the form members and end connector together.

* * * * *